United States Patent [19]

Osano

[11] Patent Number: 5,002,832

[45] Date of Patent: Mar. 26, 1991

[54] PRESSURE-SENSITIVE RECORDING MEDIUM

[75] Inventor: Nagato Osano, Kawasaki, Japan

[73] Assignee: Canon Kabushiki Kaisha, Tokyo, Japan

[21] Appl. No.: 259,702

[22] Filed: Oct. 19, 1988

[30] Foreign Application Priority Data

Oct., 1987 [JP] Japan ..... 62-268846

[51] Int. Cl.[5] ..... B41M 5/03

[52] U.S. Cl. ..... 428/474.4; 428/195; 428/474.7; 428/475.2; 428/476.9; 428/914

[58] Field of Search ..... 428/195, 207, 211, 435, 428/475.2, 477.7, 474.4, 474.9, 475.5, 476.9, 479.3, 913, 914, 474.7

[56] References Cited

U.S. PATENT DOCUMENTS

| | | | |
|---|---|---|---|
| 3,825,437 | 7/1974 | Blair | 428/474.4 |
| 3,904,790 | 9/1975 | Maida | 427/261 |
| 4,251,276 | 2/1981 | Ferrie et al. | 106/27 |
| 4,260,664 | 4/1981 | Dapp et al. | 428/523 |
| 4,478,782 | 10/1984 | Kuder et al. | 428/458 |
| 4,552,634 | 11/1985 | Franey | 524/375 |
| 4,690,858 | 9/1987 | Oka et al. | 428/914 |

FOREIGN PATENT DOCUMENTS

| | | | |
|---|---|---|---|
| 191498 | 8/1986 | European Pat. Off. | 428/474.4 |
| 61-189994 | 2/1985 | Japan | 428/474.4 |
| 61-277486 | 12/1986 | Japan | 428/474.4 |
| 941549 | 11/1963 | United Kingdom | 428/474.4 |

OTHER PUBLICATIONS

Chemical Abstracts, Tenth Collection Index, vol. 86–95, 1977–1981, pp. 1327G–1328 G.

"Kirk Othmer Encyclopedia of Chemical Technology", vol. 22, pp. 531–532.

B. L. Beach et al., "Matrix Transfer Medium Formulation", IBM Technical Disclosure Bulletin, vol. 26, No. 2, Jul. 1983, pp. 716–717.

*Primary Examiner*—Pamela R. Schwartz

*Attorney, Agent, or Firm*—Fitzpatrick, Cella, Harper & Scinto

[57] ABSTRACT

A pressure-sensitive recording medium comprises an ink layer held on a substrate wherein said ink layer contains a polyamide resin containing 74 mol % or more of a dimer acid as the acid component and has a weight average molecular weight in the range of 4,000 to 9,500.

5 Claims, No Drawings

PRESSURE-SENSITIVE RECORDING MEDIUM

BACKGROUND OF THE INVENTION

1. Field of the Invention

This invention relates to a pressure-sensitive recording medium to be used for a pressure-sensitive recording device such as typewriter, etc. More particularly, the present invention relates to a novel pressure-sensitive recording medium which has been deviced to exhibit good transfer performance event at small impact pressure or impact energy during recording.

2. Related Background Art

There have been heretofore been widely used typewriters which perform printing by utilizing impact pressure by means of a type bar or a print ball, and also various pressure-sensitive recording media such as correctable ink ribbon, etc. have been also known. However, in recent years, there is an increasing demand for making the noise during printing operation lower, and typewriters utilizing a daisy wheel in place of the type bar or print ball as mentioned above are becoming to be employed widely. The typewriter utilizing a daisy wheel, in place of employing the printing method of printing letters by strong impact pressure as in the case of the typewriter utilizing the type bar or the print ball, utilizers an impact system in which the printing letters are lightly pushed as suitable for effecting lower noise, but even such system cannot be said to satisfy fully the requirements for lowered noise yet. Thus, efforts have been made to further lower impact pressure or impact energy.

Whereas, the pressure-sensitive recording medium as proposed in U.S. Pat. No. 3,825,437 such as the above correctable ink ribbon, etc. is generally constituted by use of a film substrate and having an ink layer composed mainly of a film forming resin, namely a high molecular weight resin having generally a weight average molecular weight of 20,000 or more and an oil substantially non-compatible with said resin. In such a pressure-sensitive transfer recording medium, when printing is performed at weak impact pressure or low impact energy, poor transfer such as letter defect, etc. has occurred frequently thereby making it difficult to obtain satisfactory sharp printed images. Also, when printing is performed at such weak impact pressure or low impact energy, the printed image on a material to be attached such as paper is under the state where printed images are weakly attached on the surface of the material to be attached, whereby there ensue such problems as the printed images being readily peeled off when a force such as friction or bending is applied.

SUMMARY OF THE INVENTION

An object of the present invention is to provide a pressure-sensitive recording medium which solved the problems of the pressure-sensitive recording medium of the prior art as described above and can form sufficiently sharp printed images even by printing at a weak impact pressure or with low impact energy.

Another object of the present invention is to provide a pressure-sensitive recording medium having excellent transfer performance also with good adhesiveness to the material to be attached.

According to the present invention, there is provided a pressure-sensitive recording medium comprising an ink layer held on a substrate, wherein the above ink layer contains a polyamide resin containing 74 mol % or more of a dimer acid as the acid component and has a weight average molecular weight in the range of 4,000 to 9,500.

The polyamide resin to be used in the pressure-sensitive recording medium of the present invention contains 74 mol % or more of a dimer acid as the acid component and also has a weight average molecular weight in the range of 4,000 to 9,500. In the pressure-sensitive recording medium of the present invention, good recording without letter defect, etc. can be performed even at weak impact pressure or low impact energy and further it is possible to solve the problem of the so called back transfer, namely migration of the ink layer back to the substrate, which may be a factor for causing defective transfer.

The polyamide resin to be used in the present invention, which contains as much as 74 mol % or more of a dimer acid, is very small in "dispersibility" as represented by (weight average molecular weight)/(number average molecular weight) and also excellent uniformity of chain length, whereby excellent printing performance, particularly good letter cutting, sharpness, are imparted to the pressure-sensitive recording medium of the present invention, and also it may be estimated that the environment resistant characteristics such as printing performance or storage stability under various environments could be also improved partially thereby. The polyamide resin to be used in the present invention, as different from resin binders having weight average molecular weights of 20,000 or higher to be used for prevention of back transfer or reinforcement of film properties, is defined to have a weight average molecular weight of 4,000 to 9,500. This appears to have lowered agglomeration force of the ink layer, thereby ensuring good printing performance even at weak impact pressure and low impact energy, and also giving satisfactory results concerning back transfer and film properties along with small dispersibility as mentioned above.

DETAILED DESCRIPTION OF THE PREFERRED EMBODIMENTS

The pressure-sensitive recording medium of the present invention contains a polyamide resin in an amount of 35 to 50% by weight, preferably 38 to 45% by weight, in the ink layer.

Also, in the ink layer of the pressure-sensitive recording medium may be contained various oils as the binder in addition to the above polyamide resin similarly as in the pressure-sensitive recording medium of the prior art, if desired. The above oil in the pressure-sensitive recording medium has been considered to have the function of making therein brittle to make it readily broken, simultaneously with the function of lowering adhesiveness between the ink layer and the substrate, or the function of effecting good printing through agglomeration destruction of the boundary layer of the above oil during impact to thereby effect adhesion of the ink layer with the material to be attached. Such actions of the oil are also similar in the present invention.

A preferable polyamide resin to be used in the present invention is obtained by dehydrating condensation with amine component such as various diamines (preferably $C_2$ to $C_{10}$ straight chain diamines).

As the acid component of the polyamide resin, those containing 94 mol % or more of dimer acid are preferred, and those with weight average molecular weights in the range of 7,000 to 8,500 are preferred.

As a preferable dimer acid, there may be employed a dimer of at least one acid selected from linoleic acid and oleic acid, namely at least one dimer acid selected from dimer of oleic acid dimer of oleic acid and dimer of linoleic acid and oleic acid.

Also, as the acid component of the polyamide resin, other than dimer acid, for example, monofunctional, trifunctional acid components may be contained. When such other acid components are contained, they should be preferably contained within the range which does not exceed 16 mol %.

In constituting the pressure-sensitive recording medium of the present invention, substrates of various materials and shapes such as known plastic films, etc. to be used in the pressure-sensitive recording medium of the prior art can be widely used, but preferably plastic films such as polyethylene, polypropylene, polyethylene terephthalate, aramide, etc. can be employed. The thickness of the substrate may be preferably about 3 to 15 μm in the laminated direction of the ink layer.

The polyamide resin to be contained in the ink layer laminated on the above substrate contains 74 mol % or more of dimer acid as the acid component as described above and is obtained preferably by dehydrating condensation of various diamines, preferably $C_2$ straight diamine (ethylenediamine) as the amine component. Such polyamide resin itself has specific physical and chemical characteristics, but in the present invention it is required to have a weight average molecular weight (Mw) of 4,000 to 9,500, preferably a number average molecular weight (Mn) of 2,500 to 6,000, a softening point of 110° C. to 150° C., an acid value of 1.0 mg with KOH per 1 g and an amine value of 3.0 mg or less with KOH per 1 g. Among them, dimer acid type polyamide resins having Mw of about 8,000, Mn of about 4,500, a softening point of about 135° C., an acid value of about 0.5 mg with KOH per 1 g and an amine value of about 2.0 mg with KOH per 1 g are particularly preferred.

As the oil to be used together with the above resin, there may be included one or mixture of two or more kinds of, for example, mineral oils, n-paraffin, linseed oil, rapeseed oil, lecithin, castor oil, cottonseed oil, butyl stearate, isopropyl laurate, isocetyl stearate polyethylene glycol, etc.

The ink layer of the pressure-sensitive recording medium of the present invention is constituted by incorporating, if necessary, an oil or a colorant into the polyamide resin as described above. As the colorant, various pigments and dyes as represented by, for example, carbon black may be employed, and the thickness of the ink layer to be laminated on the substrate may be preferably about 1 to 5 μm. Of course, in the ink layer, in addition to the above oils or colorants, various additives used in the pressure-sensitive recording medium of the prior art may be also contained.

The present invention is described in more detail by referring to Examples, but the present invention is not limited by such Examples at all.

EXAMPLE 1

| Ink composition | |
|---|---|
| Formulated components | Formulation ratio (parts by weight) |
| Polyamide resin | 60 |
| Modifier (rapeseed oil) | 22 |
| Plasticizer (butyl stearate) | 38 |
| Colorant (carbon black) | 15 |

By use of a polyamide resin containing a weight average molecular weight (Mw) of 8,000 and 95 mol % of a dimer acid (here a dimer of linoleic acid and oleic acid) as the acid component, 50 parts by weight of said resin were dissolved in a solvent mixture comprising about 4/5 of isopropanol and about 1/5 of toluene, and then the modifier, the plasticizer and carbon black were added in the above parts to the solution, followed by crushing under stirring by an attritor for 2 hours to obtain the above ink composition having a uniform composition.

After the composition was coated onto a high density polyethylene film with a thickness of 14 μm, the coated product was cut into 8 mm width to obtain a present-sensitive recording medium of the present invention formed as the ink ribbon. The amount coated was made about 3.0 g/m$^2$ of the weight after drying. Other acid components than the dimer acid of the polyamide resin were made malonic acid, and $C_2$ diamine was used as the diamine.

The polyamine resin has a Mn of about 4,500, a softening point of about 135° C. an acid value of about 0.5 mg per 1 g with KOH and an amine value of about 2.0 mg.

The ink ribbon was mounted on an electronic typewriter of the daisy wheel type (produced by Canon K.K., trade name: AP-560), and recording was performed at an impact energy of 2 to 25 mJ/mm$^2$ to obtain the results shown in Table 1. Good printed images without letter defect or back transfer could be obtained on the recording paper.

In Table 1, only the results in the case of an impact energy of 3.0 mJ/mm$^2$ are shown by way of example.

EXAMPLE 2

| Ink composition | |
|---|---|
| Formulated components | Formulation ratio (parts by weight) |
| Polyamide resin | 50 |
| Mineral oil (fluid paraffin) | 43 |
| Plasticizer (isopropyl laurate) | 17 |
| Colorant (carbon black) | 15 |
| Shielding agent (silica) | 6 |

Example 1 was repeated except that the above ink composition was used to obtain an ink ribbon similarly as in Example 1.

EXAMPLE 3–4

Example 1 was repeated except that the contents of the dimer acid were 74 mol % to 90 mol % to obtain ink ribbon similarly as in Example 1.

COMPARATIVE EXAMPLE 1

Example 1 was repeated except that a polyamide resin containing 70 mol % of the dimer acid was used.

The results of evaluation of the recording characteristics of the ink ribbon conducted similarly as in Example 1 are shown in Table 1.

As is apparent from the table 1, an evident relationship can be seen from the content of dimer acid and printing performance, and in the pressure-sensitive recording media of the present invention with dimer acid content of 74 mol % or higher, good printing performance was exhibited without generation of back transfer even at a low impact energy of about 3.0 mJ/mm$^2$.

TABLE 1

| | Relationship between acid component and printing performance | | | |
|---|---|---|---|---|
| | Content of dimer acid (mol %) | Impact energy (mJ/mm$^2$) | Printing quality | Back transfer |
| Example 1 | 95 | 3.0 | ◎ | ◎ |
| Example 2 | 95 | 3.0 | ◎ | ◎ |
| Example 3 | 74 | 3.0 | ○ | ○ |
| Example 4 | 90 | 3.0 | ○ | ○ |
| Comparative Example 1 | 70 | 3.0 | x | Δ |

Note 1: standards for evaluation of letter quality
◎ excellent (no letter defect, letter cutting, letter boldness, etc. at all)
○ good (less than 15% of letter defect, letter cutting, letter boldness, etc.)
Δ passable (less than 30% of letter defect, letter cutting, letter boldness, etc.)
x unpassable (30% or more of letter defect, letter cutting, letter boldness, etc.)
Note 2: standard for back transfer
◎ (no back transfer at all at the winding core portion of ink ribbon)
○ (back transfer length less than 7 cm at the core portion)
Δ (back transfer length less than 30 cm at the core portion)
x (back transfer length of 30 cm or longer at the core portion)
Note 3: weight average molecular weight (Mw) = 8000

EXAMPLE 5, 6

Ink ribbons were prepared in the same manner except for changing the weight average molecular weights of the polyamide resin to 4,000 and 9,500 as shown in Table 2.

The recording characteristics of the ink ribbons were evaluated similarly as in Example 1 to obtain the results shown in the table 2.

COMPARATIVE EXAMPLE 2-5

Ink ribbons were prepared in the same manner as in Example 1 except for changing the weight average molecular weight of the polyamide resin to 3,000, 10,000, 15,000 and 20,000 as shown in Table 2.

The recording characteristics of the ink ribbons were evaluated similarly as in Example 1 to obtain the results shown in Table 2.

As is apparent from the Table 2, the pressure-sensitive recording media of the present invention having weight average molecular weight ranging from 4000 to 9500 exhibited good printing performance without generation of back transfer.

In contrast, for those having weight average molecular weight exceeding 9500, letter collapsing, etc. was generated to lower printing performance. This may be considered to be due to the fact that the agglomerating force of the ink layer is increased with increase in weight average molecular weight, whereby no printing of sharp letter can be effected at a weak impact pressure.

On the other hand, for those with weight average molecular weights less than 4000 printing performance was good, but back transfer was generated. This may be considered to be due to the fact that the film characteristics of the ink layer were lowered with lowering in molecular weight.

COMPARATIVE EXAMPLE 6

A pressure-sensitive recording medium of the prior art type was prepared in the same manner as in Example 1 except that the polyamide resin of Example 1 was changed to a vinyl chloride-vinyl acetate copolymer.

When the recording characteristics of the recording medium were evaluated similarly as in Example 1 an impact energy of at least 15 mJ/mm$^2$ was required for obtaining good printed images, and printing badness such as letter defect, etc. occurred at less impact energy than this.

TABLE 2

| | Relationship between acid component and printing performance | | | |
|---|---|---|---|---|
| | Weight average molecular weight (Mw) | Impact energy (mJ/mm$^2$) | Printing quality | Back transfer |
| Example 5 | 4000 | 3.0 | ○ | ○ |
| Example 1 | 8000 | 3.0 | ◎ | ◎ |
| Example 6 | 9500 | 3.0 | ○ | ○ |
| Comparative example 2 | 3000 | 2.8 | ○ | x |
| Comparative example 3 | 10000 | 3.8 | Δ | ○ |
| Comparative example 4 | 15000 | 7.0 | x | ○ |
| Comparative example 5 | 20000 | 15.0 | x | ○ |

Note 1: standards for evaluation of letter quality
◎ excellent (no letter defect, letter cutting, letter boldness, etc. at all)
○ good (less than 15% of letter defect, letter cutting, letter boldness, etc.)
Δ passable (less than 30% of letter defect, letter cutting, letter boldness, etc.)
x unpassable (30% or more of letter defect, letter cutting, letter boldness, etc.)
Note 2: standards for back transfer
◎ (no back transfer at all at the winding core portion of ink ribbon)
○ (back transfer length less than 7 cm at the core portion)
Δ (back transfer length less than 30 cm at the core portion)
x (back transfer length of 30 cm or longer at the core portion)
Note 3: dimer acid content 95 mol %

In the above respective examples, weight average molecular weight was measured as described below.

Kind of machine: trade name "Trirotar II", produced by Nippon Bunko Co.

Column: trade name: Shodex GPC A-800P, A-802, A-804 (produced by Showa Denko Co.)

Carrier: tetrahydrofuran

Column temperature: 40° C.

Amount injected: 100 μl

Flow rate: 1.0 ml/min.

Detector: RI (reference index)

Sample preparation: the polymer was dissolved in isopropyl alcohol/toluene=7/3 to a solid concentration of 40 vol. % and diluted to 3 vol. % with tetrahydrofuran.

As described above, in the pressure-sensitive recording medium of the present invention, good printing images without transfer badness such as letter defect, etc. can be obtained at a low impact energy of about 3 mJ/mm$^2$, and also without generation of back transfer. The noise during printing was found to be 48 decibel even in printing at the low impact energy of 3 mJ/mm$^2$.

In contrast, when printing was performed by the above typewriter by use of an ink ribbon of the prior art type, an impact energy of at least 15 mJ/mm$^2$ was required for obtaining a printed image without defective transfer. No good image could be obtained at smaller impact energy than this level. Also, the noise was at high level of 75 decibel or higher.

As described above, in the pressure-sensitive recording medium of the present invention, as compared with the pressure-sensitive recording medium of the prior art, the impact energy can be reduced to substantially about one fifth, whereby the noise can be reduced to about one half. Thus, the pressure-sensitive recording medium of the present invention is extremely useful for the daisy wheel type typewriter for which lowered noise is required in these days.

What is claimed is:

1. A pressure-sensitive transfer recording medium comprising an ink layer held on a substrate said ink layer including a colorant, an oil, and a polyamide resin comprising 74 mol % or more of a dimer acid as the acid component and having a weight average molecular weight in the range of 4,000 to 9,500.

2. A pressure-sensitive transfer recording medium according to claim 1, wherein 94 mol % or more of the dimer acid is contained as the acid component.

3. A pressure-sensitive transfer recording medium according to claim 1, wherein the weight average molecular weight of the polyamide resin is 7,000 to 8,500.

4. A pressure-sensitive transfer recording medium according to claim 1, wherein the dimer acid is a dimer of at least one acid selected from linoleic acid and oleic acid.

5. A pressure-sensitive transfer recording medium according to claim 1, wherein the content of the polyamide resin in the ink layer is 35 to 50 wt. %.

* * * * *

UNITED STATES PATENT AND TRADEMARK OFFICE

CERTIFICATE OF CORRECTION

PATENT NO. : 5,002,832
DATED : March 26, 1991
INVENTOR(S) : NAGATO OSANO

It is certified that error appears in the above-identified patent and that said Letters Patent is hereby corrected as shown below:

ON THE TITLE PAGE:

IN [30] FOREIGN APPLICATION PRIORITY DATA

"Oct., 1987 [JP]" should read --Oct. 23, 1987 [JP]--.

COLUMN 1

Line 10, "deviced" should read --devised--.
Line 11, "event" should read --even--.
Lines 23-24, "to be employed widely" should read --widely employed--.
Line 27, "utilizers" should read --utilizes--.
Line 28, "as suitable for" should read --thereby-- and "noise," should read --noise.--.
Line 29, "but even such system" should read --Even such a system, however,-- and "satisfy fully" should read --fully satisfy--.
Line 30, "yet" should be deleted.
Line 56, "solved" should read --solves--.
Line 63, "having" should read --that has--.

COLUMN 2

Line 53, "above" should be deleted.
Line 55, "function" should read --dual function--; "making therein" should read --becoming--; and "to make it" should read --and thereby--.
Line 56, "simultaneously with the function of" should read --while simultaneously--.

UNITED STATES PATENT AND TRADEMARK OFFICE

CERTIFICATE OF CORRECTION

PATENT NO. : 5,002,832

DATED : March 26, 1991

INVENTOR(S) : NAGATO OSANO.

It is certified that error appears in the above-identified patent and that said Letters Patent is hereby corrected as shown below:

COLUMN 5

Line 61, "increase" (second occurrence) should read --the increase--.

COLUMN 7

Line 14, "substrate" should read --substrate,--.

Signed and Sealed this

Fifteenth Day of December, 1992

*Attest:*

DOUGLAS B. COMER

*Attesting Officer*

*Acting Commissioner of Patents and Trademarks*